US010208771B2

(12) United States Patent
Lewendon

(10) Patent No.: US 10,208,771 B2
(45) Date of Patent: Feb. 19, 2019

(54) RETRACTABLE TELESCOPIC PISTON

(71) Applicant: EDO MBM Technology Limited, Brighton (GB)

(72) Inventor: James Lewendon, Brighton (GB)

(73) Assignee: EDO MBM Technology Limited, Brighton (GB)

( * ) Notice: Subject to any disclaimer, the term of this patent is extended or adjusted under 35 U.S.C. 154(b) by 155 days.

(21) Appl. No.: 15/515,286

(22) PCT Filed: Sep. 29, 2015

(86) PCT No.: PCT/GB2015/052827
§ 371 (c)(1),
(2) Date: Mar. 29, 2017

(87) PCT Pub. No.: WO2016/051156
PCT Pub. Date: Apr. 7, 2016

(65) Prior Publication Data

US 2017/0241452 A1 Aug. 24, 2017

(30) Foreign Application Priority Data

Sep. 30, 2014 (GB) ..... 1417314

(51) Int. Cl.
*F15B 15/16* (2006.01)
*F15B 15/26* (2006.01)

(52) U.S. Cl.
CPC ..... *F15B 15/16* (2013.01); *F15B 15/261* (2013.01)

(58) Field of Classification Search
CPC ..... F15B 11/15; F15B 11/16; F15B 15/165; F15B 16/261
(Continued)

(56) References Cited

U.S. PATENT DOCUMENTS 3,831,901 A 8/1974 Williams et al.
4,471,944 A 9/1984 Leray et al.
6,234,062 B1 * 5/2001 Griffin ..... F15B 15/1466 92/23

FOREIGN PATENT DOCUMENTS

DE 3324270 8/1986
DE 202012103180 11/2012
(Continued)

OTHER PUBLICATIONS

International Patent Application No. PCT/GB2015/052827, Search Report and Written Opinion, dated Dec. 21, 2015.
(Continued)

*Primary Examiner* — F Daniel Lopez
*Assistant Examiner* — Daniel S Collins
(74) *Attorney, Agent, or Firm* — Kilpatrick Townsend & Stockton LLP; Dean W. Russell

(57) ABSTRACT

A two-stage, fully self-retracting, telescopic fluid actuator suitable for high speed ejection applications comprises a detent 38, 64, 26, which locks a cylinder 6 in an extended position for extension of a piston 3 therefrom. The detent is released by retraction of the piston into the cylinder again, e.g. under spring bias, so that the actuator is fully self-retracting. A locking ball 38 of the detent also serves to latch the piston and cylinder to each other for the first stage of the actuator extension. In an alternative embodiment, cam means (80, 117 FIGS. 10, 11 and 13) and plungers (90, FIGS. 10, 12, 13 and 15) perform the detent and latching functions.

24 Claims, 8 Drawing Sheets

(58) Field of Classification Search
USPC ..... 91/156, 183
See application file for complete search history.

(56) References Cited

FOREIGN PATENT DOCUMENTS

| | | |
|---|---|---|
| EP | 1473466 | 11/2004 |
| GB | 2335004 | 9/1999 |
| JP | S4835660 | 10/1973 |

OTHER PUBLICATIONS

United Kingdom Patent Application No. 1417314.0, Combined Search and Examination Report, dated Mar. 23, 2015.

* cited by examiner

RETRACTABLE TELESCOPIC PISTON

CROSS-REFERENCE TO RELATED APPLICATIONS

This patent application is the U.S. national phase of International Patent Application No. PCT/GB2015/052827, filed on Sep. 29, 2015, which application claims priority to United Kingdom Patent Application No. 1417314.0, filed on Sep. 30, 2014, the contents of both of which are incorporated herein by reference.

This invention relates to fluid actuators and particularly although not exclusively pneumatic or gas powered actuators. High speed actuators are often energised by compressed gas (e.g. nitrogen or pyrotechnically generated gas) when high forces and speed of actuation are vital, such as in emergency release or ejection actuation systems.

A major problem with such systems which use a discrete volume of pressurised gas, is the large gas storage receiver needed to maintain a reasonably sustained pressure as the internal swept volume of the actuator increases during its stroke. It is desirable to make effective use of the stored energy in the compressed gas. For an emergency release or ejection system, measures of effectiveness include energy efficiency, thrust efficiency and hence the velocity imparted to an inertial load. Thrust efficiency is defined as equivalent average force divided by peak force applied to the load by the actuator. Energy efficiency is defined as the expansion work done by the gas divided by the total energy available from adiabatic expansion of the gas to zero relative pressure. The importance of the peak force is that it is usually limited by the physical properties and/or the allowable reaction force which can be tolerated by the launch platform and/or the item being ejected. Energy efficiency is important in achieving a high ejection mass final velocity from a given volume of compressed gas. Further considerations are that the actuator should desirably be compact, lightweight and yet robust.

Our patent specification GB2335004 discloses a telescopic piston design ("the '004 actuator") which compares well to prior designs on a blend of these criteria. The '004 actuator provides a piston assembly comprising an inner component, an intermediate component and an outer component, all telescopingly interfitted together, the inner component comprising a fluid outlet at one end, the intermediate component making a sliding seal with the inner component and comprising a closed end surrounding the fluid outlet end, the outer component making a first sliding seal with the intermediate component and a second sliding seal with the inner component, and a detent operative to hold the outer component in an extended position relative to the inner component. A latching arrangement preferably locks the intermediate component to the outer component to ensure that they travel together during a first expansion stage of the actuator, but is then released to allow relative movement between the intermediate and outer components during a second expansion stage of the actuator. An outer housing is preferably provided which additionally supports and stabilises the intermediate and outer components, and acts as a mounting for the detent.

Whilst the '004 actuator represents a considerable improvement over prior piston actuators, it still suffers from various shortcomings. One problem is that it is non-retractable. This is undesirable e.g. in store ejection applications on an aircraft, where the extended actuator will increase drag and adversely affect aircraft performance and perhaps flight stability. The actuator has to be manually retracted by ground crew after completion of the mission, which complicates and slows store replenishment. Where the latching arrangement is not used, under some conditions the detent may not engage the intermediate component, causing the actuator to malfunction, with a potentially dangerous failure to deliver the full stroke and thrust to the load. Where the latching arrangement is used, under certain conditions there is still the potential for it to be released sufficiently out of sequence to result in non-engagement of the detent and a similar potentially dangerous malfunctioning of the actuator.

The present invention aims to mitigate some or all of these problems and accordingly provides a piston assembly comprising an inner component, an intermediate component and an outer component, all telescopingly interfitted together, the inner component comprising a fluid outlet at one end, the intermediate component making a sliding seal with the inner component and comprising an end surrounding the fluid outlet end, the outer component making a first sliding seal with the intermediate component and a second sliding seal with the inner component, and a detent operative to hold the outer component in an extended position relative to the inner component; in which the detent is releasable by retraction of the intermediate component into the outer component, to allow relative sliding movement between the inner and outer components so that the piston assembly is retractable.

The piston assembly may comprise a valve operable to release internal fluid pressure when the assembly reaches an extended position, typically the fully extended position. The pressure release valve may operate as a result of separation of a load from the intermediate component.

The piston assembly may comprise means for biasing it towards a retracted position, typically into the fully retracted position. The biasing means may for example comprise means for connecting the interior of the piston assembly to a source of pressure lower than ambient pressure so that ambient pressure acts to cause retraction of the piston assembly. Alternatively a separate linear actuator such as a further piston and cylinder arrangement may be provided to return the piston assembly to the retracted state. However, preferably the piston assembly is resiliently biased towards the retracted state, for example by a tension spring.

The detent is conveniently mounted to a proximal end of the outer component, where it may be released by engagement with a proximal end of the intermediate component, as the intermediate component moves towards a retracted position relative to the outer component.

The intermediate component may be latched to the outer component so that the outer component is transported with the intermediate component during an initial stage of piston extension. For example, a radially movable latching element may be engageable in a recess made in a bore of the outer component, and is prevented from disengaging from this recess until the end of the initial extension stage, by an outer surface of the inner component.

The piston assembly may comprise an outer support structure or housing that guides and supports the outer component for sliding movement along the inner component.

The detent may comprise a component that is radially outwardly biased for reception in an internal recess in the support structure when the outer component is in an extended position.

The radially outwardly biased component may be held in a recess in an outer surface of the intermediate component by an inner surface of the support structure or housing thereby to comprise the latching element.

The detent may further comprise a locking component that is biased axially of the outer component so as to move behind the radially outwardly biased component and lock it in the extended position. The locking component may cam the radially outwardly biased component radially outwardly as the outer component reaches its fully extended position. The locking component may contact and move together with the intermediate component as the outer component is transported with the intermediate component during an initial stage of piston extension. The locking component may continue to contact the intermediate component as the locking component moves behind the radially outwardly biased component and the intermediate component begins to extend with respect to the outer component.

When the intermediate component is biased towards the retracted position, its proximal end may strike the locking component and knock it out of position from behind the radially outwardly biased component. The outer component may then act to cam the radially outwardly biased component out of the recess in the support structure and into the recess in the intermediate component, so that the outer and intermediate components may move in unison toward the fully retracted position. The radially outwardly biased component may comprise a locking ball.

The inner component may comprise a pressure bleed port communicating with an axial bore and with a space between the proximal end of the outer component and the locking component, as the locking component moves behind the radially outwardly biased component. An interior space within the outer support structure or housing may comprise a pressure bleed port in communication with a pressurized fluid supply.

Alternatively, the radially outwardly biased component may be engaged and moved radially inwardly by a cam finger at the proximal end of the intermediate component as the intermediate component moves towards its fully retracted position relative to the outer component. The intermediate component may be separately latched to the outer component so that the outer component is transported with the intermediate component during an initial stage of piston extension. For example, a separate radial latching element may be engageable in a recess made in a bore of the outer component, and is prevented from disengaging from this recess until the end of the initial extension stage, by an outer surface of the inner component.

Illustrative embodiments of the invention are described below with reference to the drawings, in which.

Figure 10:
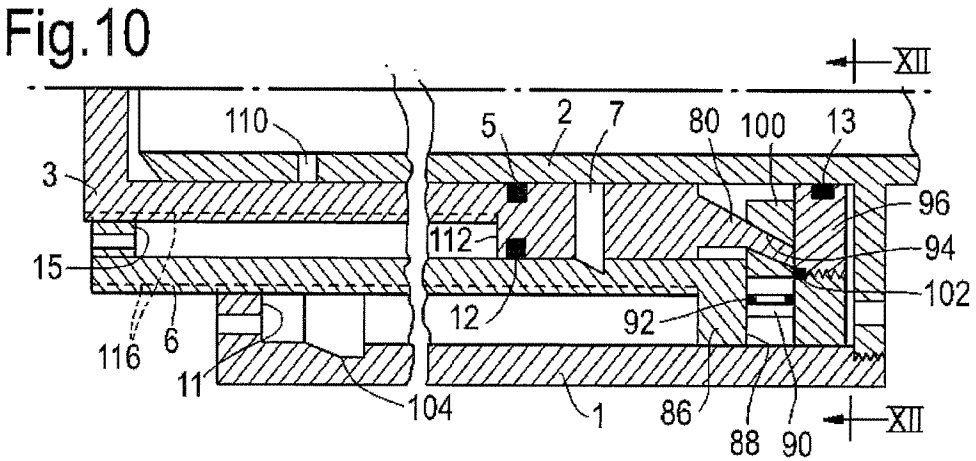
FIG. 10 is a diagrammatic partial cross-sectional view of another embodiment of the invention.
Figure 11:
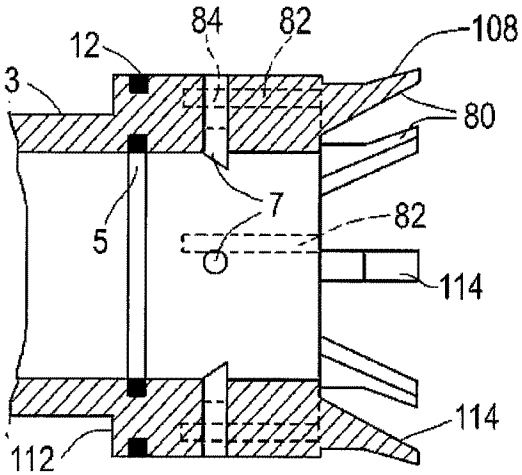
FIG. 11 is a scrap cross-sectional view of part of the intermediate component shown in FIG. 10.
Figure 13:
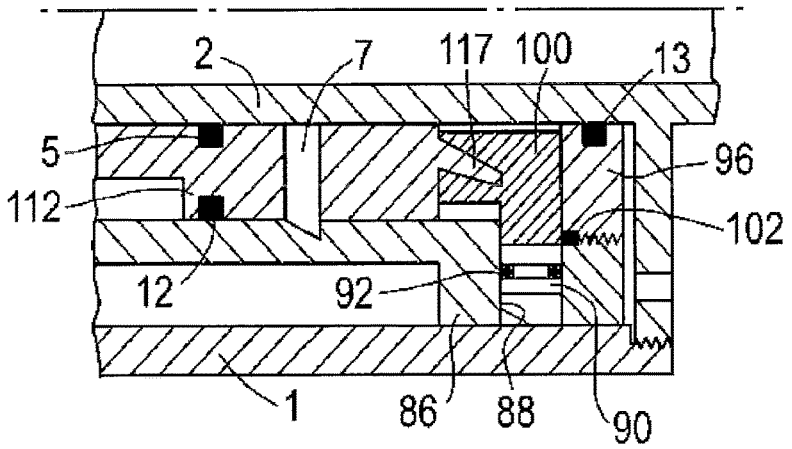
Figure 14:
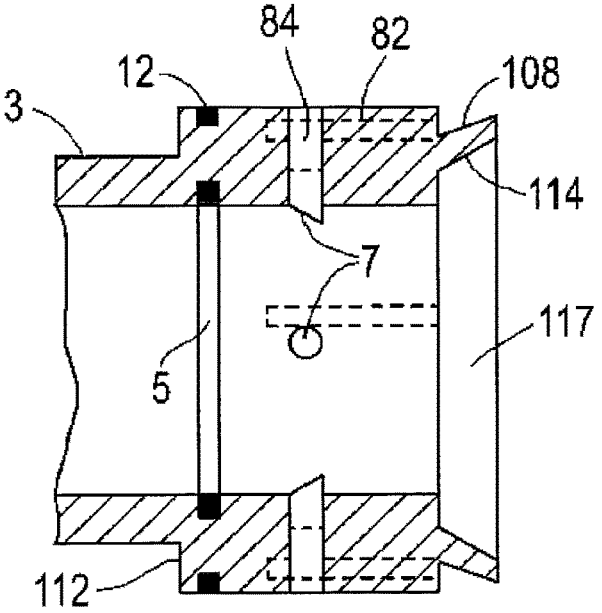
Figure 15:
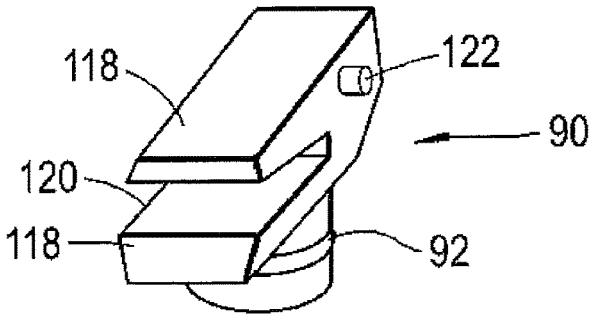

FIGS. 13 and 14 correspond to FIGS. 10 and 11 respectively, but show a modified embodiment, and FIG. 15 is a perspective view of a plunger as used in this modified embodiment.

Figure 1:
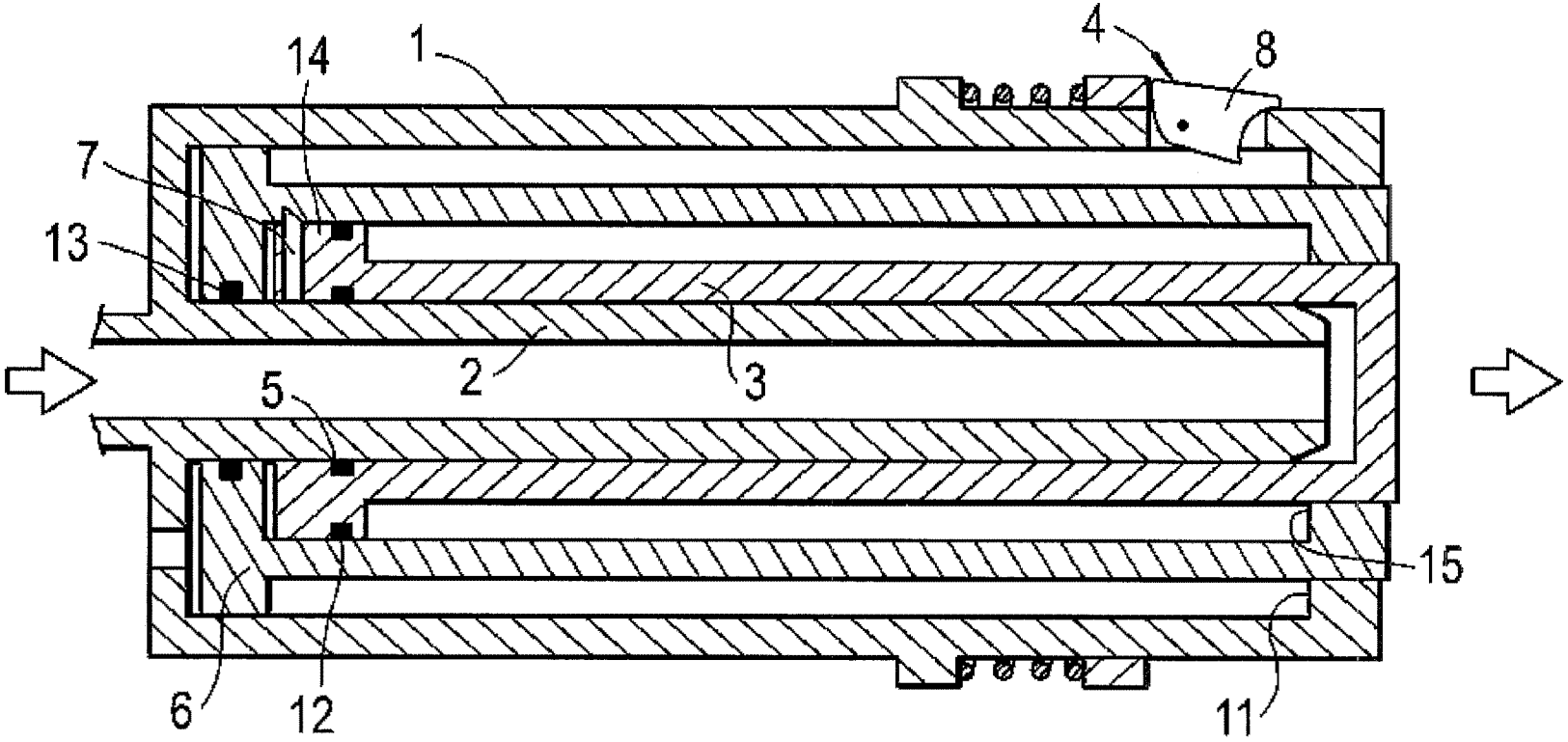
Fig.1 (Prior Art)
FIG. 1 shows in diagrammatic cross-section an actuator as disclosed in GB2335004, in the fully retracted condition.

Referring to FIG. 1, the prior art '004 actuator comprises a housing 1 which provides structural support for the moving components and features a fixed inner component in the form of a gas entry sleeve 2 whose purpose is inter alia to carry high pressure gas to the end of the intermediate component, i.e. a hollow piston 3. Mounted in the outer casing 1 is a detent system 4 for the outer component or hollow cylinder 6.

The area on which gas initially acts is defined by the outer diameter of the entry sleeve 2, which engages on a sliding gas seal 5 in the inner wall of the piston 3 to contain the gas during the first stage of telescopic extension. The cylinder 6 is sealed to the entry sleeve 2 by a sliding gas seal 13 so that relative movement between piston 3 and cylinder 6 will tend to create a partial vacuum in the sealed space between these components, with the result that atmospheric pressure acting on the left hand end of cylinder 6 as illustrated in FIG. 1 will cause it to tend to move with the piston 3 as desired. This movement may be satisfactory under ideal conditions with low frictional forces, lightweight moving components and low ram extension speeds. For a more positive interengagement, the hollow piston 3 is latched to the cylinder 6 so that the cylinder 6 is reliably transported with the piston 3 during the first stage of extension. A series of radial latching elements 7 engage in a triangular sectioned groove made in the internal diameter of the cylinder, and are prevented from disengaging before the end of the first extension stage by the outer diameter of the gas entry sleeve 2. In this way, the piston 3 and the cylinder 6 move as a single assembly during the first stage extension.

When the staging point is reached (FIG. 7), the latching elements 7 clear the entry sleeve 2 and are free to move toward the centre of the piston, thereby releasing the piston 3 from the cylinder 6. Slightly earlier, seal 5 clears the entry sleeve 2, allowing gas to enter the gap between the larger end of the piston 3 and the adjacent face of the cylinder 6 end, thereby applying an end load on these two components, attempting to separate them. The cylinder 6, however, is prevented from moving in a reverse direction by multiple pivoting dogs 8 of the detent system 4 (only one dog shown) which have engaged the cylinder 6 right hand end under the action of a spring 9 and collar 10 as the cylinder 6 is arrested by a resilient buffer 11. The dogs 8 are distributed about the circumference of the housing 1.

The gas is now contained by the piston 3, the sleeve 2, a seal 12 on the piston outer diameter and the seal 13 between the cylinder 6 and the sleeve 2 outer diameter. The piston 3, however, is free to continue its movement and in a second stage of extension travels the length of the cylinder 6 bore under the motivation provided by the gas acting now on the larger diameter of the piston head. In the final position of the components, the piston head 14 contacts a buffer 15 in the right hand end of the cylinder 6. By careful sizing of the piston outer and inner diameters, they may be matched to the volume of gas available at the start to give substantially the same force at the beginning of the first and second extension stages.

However, if during the first stage of extension the outer cylinder 6 lags behind motion of the piston 3 to a significant extent, then the detent system 4 may fail to engage and hold the cylinder 6 as intended. This may be the case if the latching elements 7 are omitted. However even when present, the latching elements 7 are released after gas pressure is admitted to the space between the left hand ends of the piston 3 and cylinder 6 and before the detent system 4 has locked into position behind the fully extended piston 6. The momentum of the cylinder 6 is therefore relied upon to carry it past the dogs 8 despite the influence of the gas pressure tending to separate the left hand ends of the piston 3 and cylinder 6. Under adverse conditions, e.g. if the piston 3 encounters abnormally high resistance, the dogs 8 may fail to engage behind the piston 6. In either case of failure of the detent system, the gas pressure now acting on the left hand end of the cylinder 6 will tend to push it back into the housing 1, so that the first stage extension fails.

Furthermore, the prior art '004 actuator is not self-retracting and has to be manually re-set from the fully extended position. Once any remaining gas pressure within the actuator has been vented, the piston 3 can be pushed into the cylinder 6. The locking dogs 8 can be tilted to their unlocked position and the cylinder 6 pushed back into the housing 1. This re-setting operation takes time and a certain degree of skill and knowledge to carry out correctly. Having to maintain the actuator in its fully extended state after operation until the opportunity arises for it to be manually re-set for the next use renders the actuator impractical for some applications.

FIGS. 2-9 show a self-retracting actuator forming a first embodiment of the invention. Similar to the '004 actuator, the actuator of this embodiment comprises a housing or structural support 1, an inner component or gas entry sleeve 2, an intermediate component or hollow piston 3 and an outer component or hollow cylinder 6. An end cap 16 mounts the sleeve 2 concentrically within the housing 1 and allows the piston 3 and cylinder 6 to be assembled telescopically within the housing 1. Annular static seals 18, 20 are provided between the end cap and the sleeve 2 and housing 1 respectively. A high pressure gas inlet 22 in the end cap 16 communicates with the hollow interior of the gas entry sleeve 2.

Again similarly to the '004 actuator, an annular sliding seal 13 is provided between a proximal end of the cylinder or outer component 6 and the gas entry sleeve or inner component 2. The seal 13 is provided in a retaining collar 24 which is screwed into the main body of the piston at the proximal end, so as to retain the piston or intermediate member 3 and an annular locking component 26 assembled within the cylinder 6. A static annular seal 28 is provided between the retaining collar 24 and the main body of cylinder 6. Similarly to the '004 actuator, an annular sliding seal 12 is provided between the piston 3 and cylinder 6. However, the sliding seal 5 between the piston 3 and gas entry sleeve 2 may be omitted, as integrated latching and detent means, as described in more detail below, are provided which act to lock the piston and cylinder together during first stage extension of the actuator.

Figure 2:
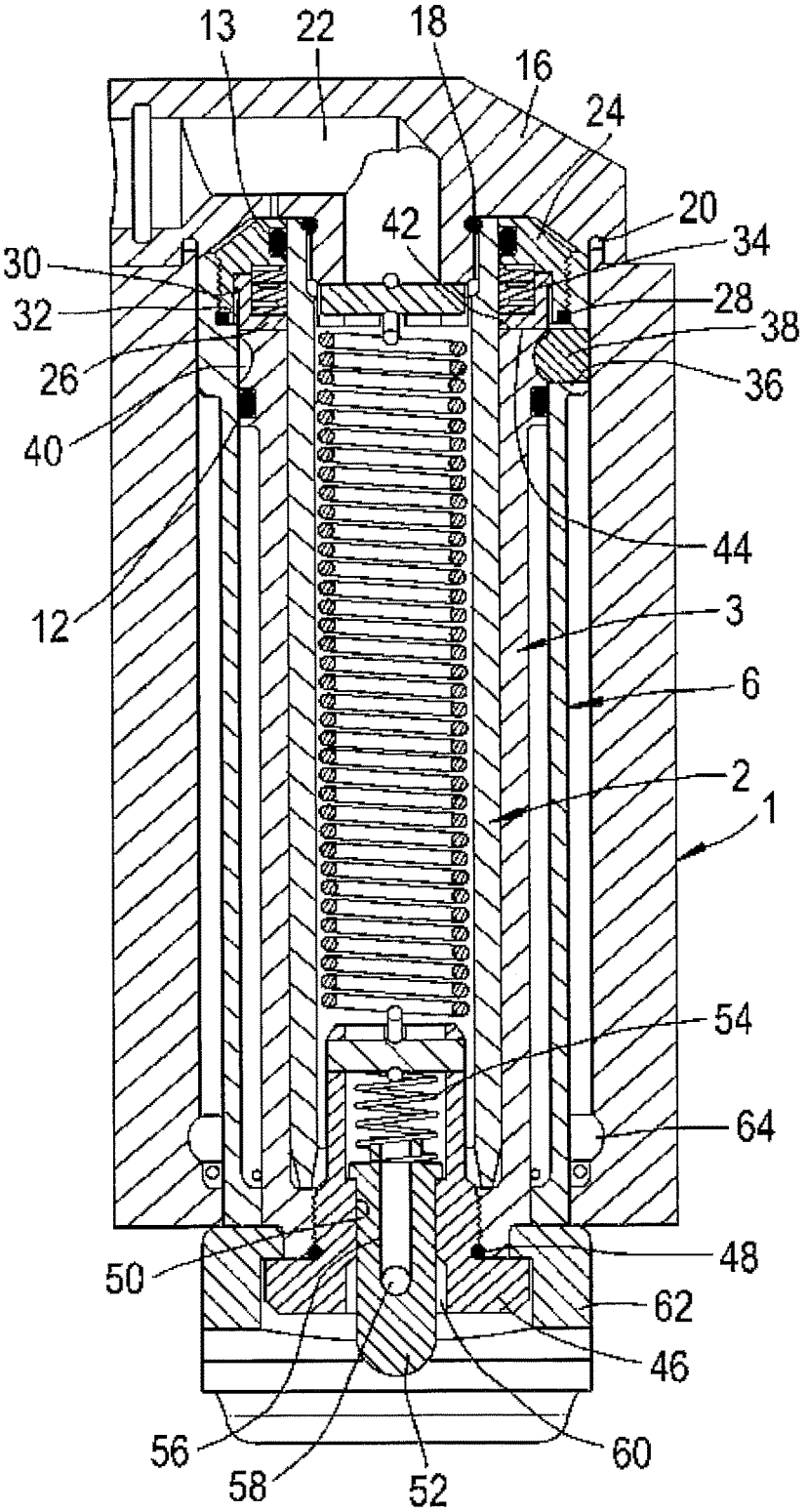
FIG. 2 is a longitudinal cross-sectional view of an actuator embodying the present invention in the corresponding fully retracted condition.

The main body of the cylinder 6 and the locking component 26 are provided with co-operating shoulders 32, 30 which limit movement of the locking component out of the retaining collar 24 in the extension direction. The locking component is biased in the extension direction by a stack of Bellville washers 34. The cylinder 6 main body is provided with a number (e.g. three or more) of windows 36 (only one of which is visible in FIG. 2) circumferentially distributed around the proximal end. Each window contains a radially outwardly biased component in the form of a locking ball 38. These each act as a detent for the cylinder 6/housing 1 and as an integrated latching element for the piston 3/cylinder 6. As shown in FIG. 2 the locking ball 38 protrudes radially inwardly from the window 36 so as to seat in a part-circular sectioned groove 40 provided around the outer circumference of the piston 3 distal end. The locking ball is held in this position by the inner surface of the housing 1. The piston 3 is thereby held in its fully retracted position in the cylinder 6. In this position, a smooth proximal end surface 42 of the piston 3 butts up against a complementary smooth surface 44 on the locking component 26 which is thereby held in its fully retracted position in the collar 24, with the Bellville washers fully compressed. The locking component 26 thus biases the piston 3 in the extension direction in the cylinder 6, which in turn biases the locking balls 38 in the radially outward direction against the housing 1 inner surface. As the locking balls 38 are trapped in the windows 36 and also trapped in the groove 40 by the housing 1 inner surface, in the configuration shown in FIG. 1 the piston 3 is latched to the cylinder 6 for linear extension movement together as a single unit.

The distal end of the cylinder 2 has a closure plug 46 screwed into it, sealed by a static annular seal 48. The plug 46 has an axial bore 50 containing a sliding valve element 52 as a sealed sliding fit, biased towards an open position by a spring 54. The valve element has an axial bore 56 in communication with the interior of the piston 3 and in communication with a transverse through bore 58. In the open position, ends of the transverse through bore 58 align with an external counterbore 60 in the plug 46 to provide a gas vent pathway from the piston interior to ambient. In the closed position of the valve element 52 (see FIG. 3), the ends of the transverse bore 58 are blocked by the inner surface of the plug bore 50. The plug 46 also secures a shoe 62 to the distal end of the piston 3, by which the actuator thrust is transferred to a store or other load to be ejected (not shown). This load when engaged in the shoe 62 pushes the valve element inwards, closing the valve. Upon disengagement of the load from the shoe, the valve element moves outwards, venting the gas pressure in the actuator.

Figure 3:
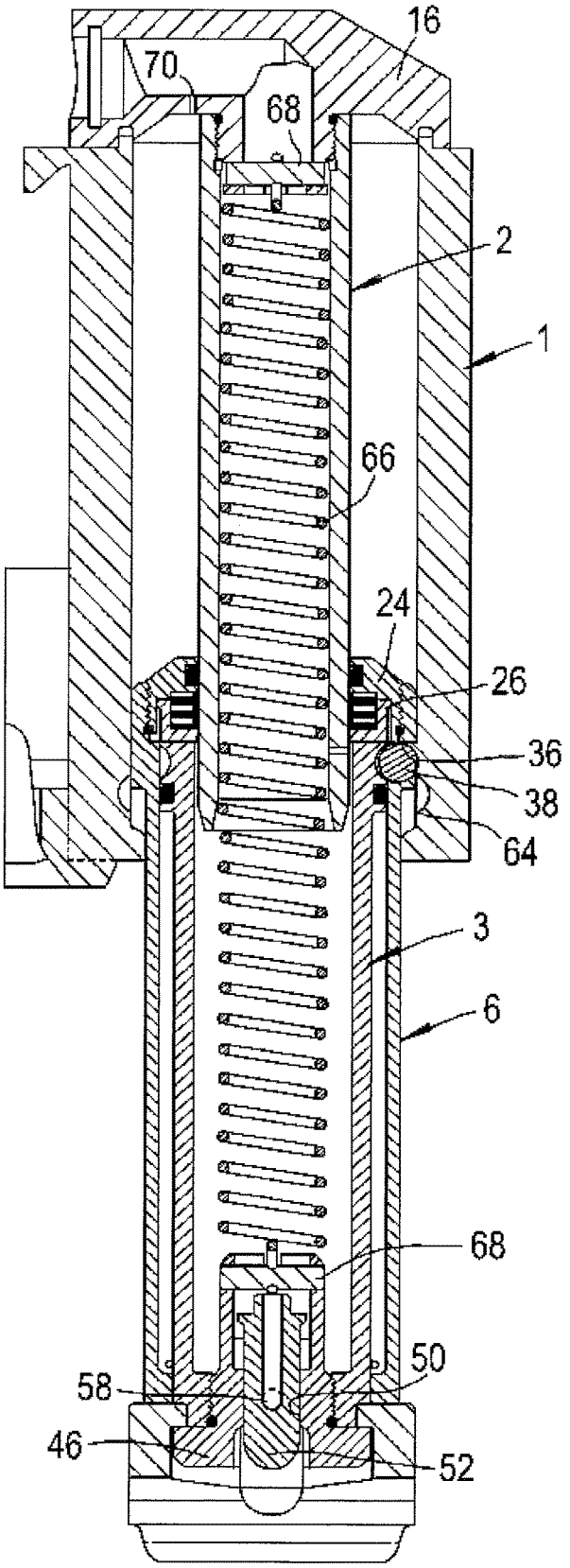
FIG. 3 shows the actuator of FIG. 2 reaching the end of extension of a first stage.

With the valve element 52 in the closed position, gas pressure applied to the inlet 22 will pressurize the interior of the piston 3 and the interior of the cylinder 6 above the seal 12. The balls 38 are a fairly gas-tight sliding fit in the windows 36, so such pressurization also assists in biasing the balls 38 radially outwardly. The applied gas pressure causes the latched together piston and cylinder 3, 6 to move in the extension direction along the gas entry sleeve 2, similarly to the '004 actuator. Such movement continues until the locking balls 38 approach a part-circular sectioned groove 64 provided around the circumference of the housing 1 inner wall, adjacent to its distal end. This condition is shown in FIG. 3. A tension spring 66 within the actuator has its ends hooked over a pair of mounting pins 68 provided one in the end cap 16 and the other in the plug 46. This spring is put under increasing tension as the actuator extends. The proximal end of the cylinder 6 is a close sliding fit in the housing 1, such that the extension movement tends to draw a vacuum in the housing above the cylinder 6. A bleed port 70 communicates with the pressurized fluid supply so as to provide a controlled rise in the pressure in the housing 1 above the cylinder 6, e.g. to provide a more even force/extension characteristic and therefore improved thrust efficiency. The size of the port may be tailored or optimized to suit different actuator operating characteristics such as extension speed and the mass of the item to be ejected. The sliding fit between the distal end of the housing 1 and the exterior of the cylinder 6 is sufficiently loose to allow gas or air venting; or dedicated flutes or other vent passageways (not shown) are provided for this purpose.

Figure 4:
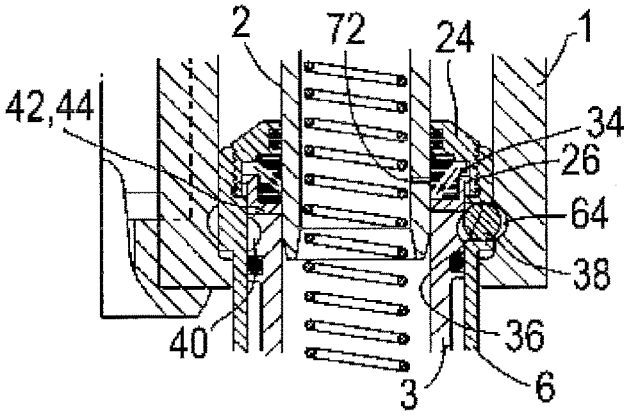
FIGS. 4-6 are detailed sequential views of the actuator showing operation of a combined latching mechanism and detent at the end of extension of the first stage and at the beginning of extension of a second stage.

FIG. 4 shows the locking ball 38 as the window 36 draws level with the housing groove 64 during extension of the cylinder 6 and piston 3. The locking ball is now free to move radially outwardly through the window 36 into the housing groove 64; the Bellville washers forcing the locking component 26 and piston 3 to move in the extension direction inside the cylinder 6; so that the groove 40 cams the locking ball out of the groove 40, through the window and into the groove 64. This movement is further assisted by a pressure bleed port 72 provided near the distal end of the entry sleeve 2. Gas pressure in the entry sleeve 2 is supplied to the cavity behind the locking component 26 as the retaining collar 24 draws level with the port 72. During movement of the locking component 26 in the cylinder 6 out of the retaining collar 24, the end surfaces 42, 44 remain in contact so that the locking component "follows" the piston 3.

Figure 5:
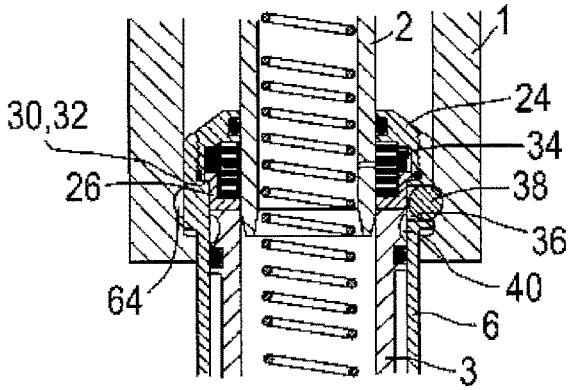
Figure 6:
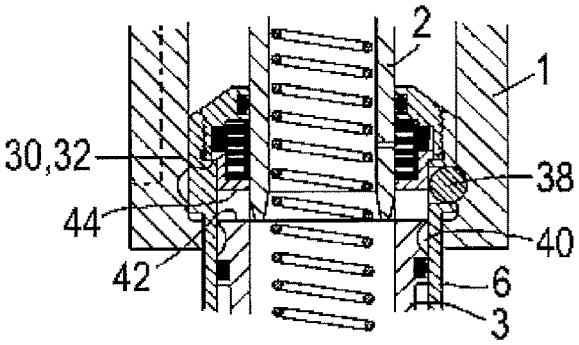

FIG. 5 shows the locking component 26 fully extended from the retaining collar 24, so that it extends behind the full diameter of the locking ball. The shoulders 30, 32 are therefore in contact with each other. The locking ball 38 has been cammed fully out of the groove 40 and now extends out of the window 36 so as to occupy the full cross-section of the groove 64. The locking component 26 in this position securely retains the locking ball 38 in the groove 64. The locking ball 38 has thus ceased to latch the piston 3 to the cylinder 6. Together with the locking component 26 it now acts instead as a detent securing the cylinder 6 to the housing 1 against relative longitudinal movement. The locking ball 38 and the radial depths of the grooves 40, 46 and window 36 are each dimensioned such that the locking ball cannot fully leave one groove without entering the other. The locking ball therefore provides a mechanical interlock which ensures that the necessary detent is applied to the cylinder or outer component 6, before the piston or intermediate member 3 is unlatched for extension out of the cylinder.

Because the locking ball 38 is now fully released from the groove 40, the piston 3 is free to extend in the cylinder 6, to provide the second extension stage of the actuator, similarly to the '004 actuator. Continued extension of the piston 3 separates its end face 42 from the corresponding end face 44 of the fully extended and now stationary locking component 26: see FIG. 6.

Figure 7:
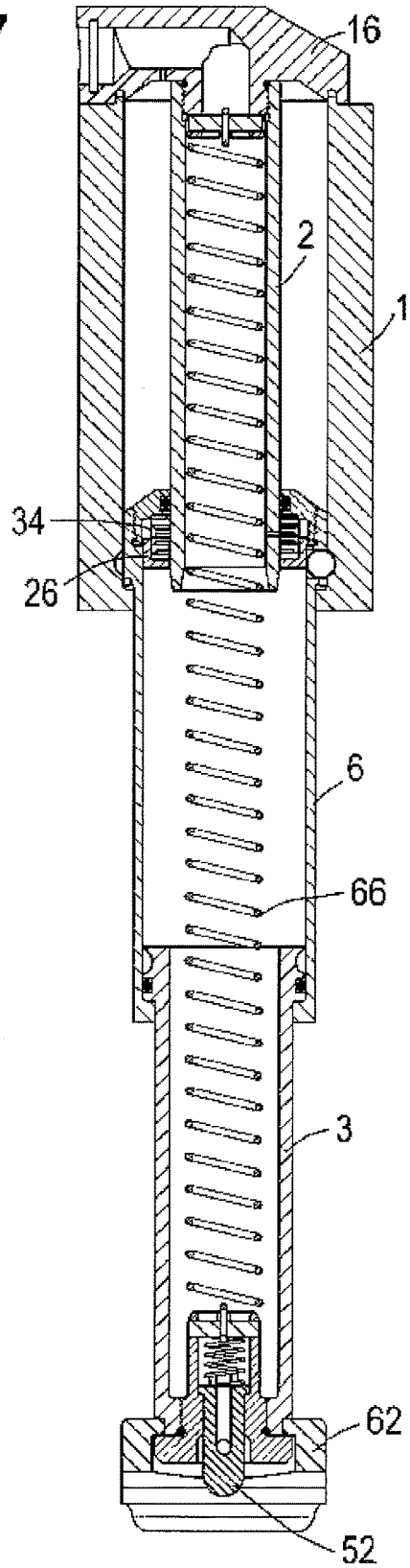
FIG. 7 shows the actuator of FIGS. 2-6 fully extended (second stage extension completed) and with a load separated.
Figure 8:
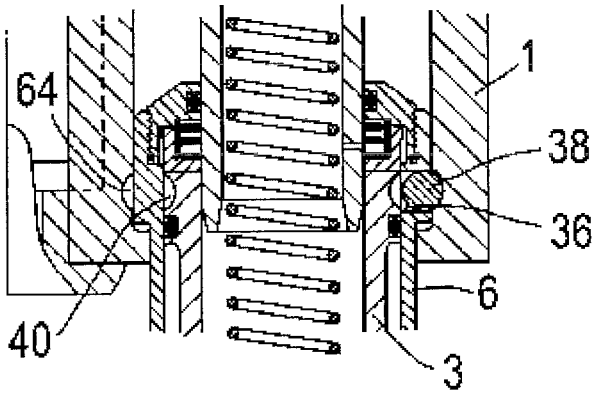
FIGS. 8 and 9 are sequential views of the latching mechanism/detent at the end of second stage retraction and the beginning of first stage retraction respectively.
Figure 9:
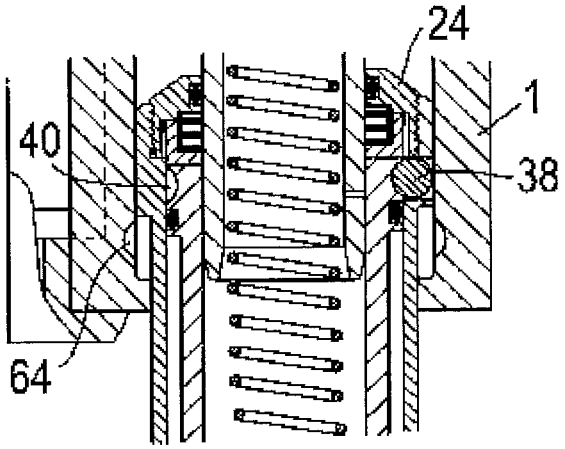

FIG. 7 shows the actuator fully extended and with the ejection load (not shown) separated from the shoe 62, so that the valve element 52 is opened. This allows the internal gas pressure to vent, so that the spring 66 can pull the piston 3 back into the cylinder 6. By the time that the piston has returned fully into the cylinder, it and the attached shoe 62 etc. has gained sufficient momentum to strike the locking component and fully compress the Bellville washers 34. This brings the locking groove 40 into alignment with the window 36, as shown in FIG. 8. The cylinder 6 now begins to retract together with the piston 3, so that the windows 36 cam the locking balls out of the groove 64 and into the groove 40. When the locking balls 38 have fully left the groove 64, they are again constrained by the inner wall of the housing 1 to stay in the groove 40. The cylinder 6 is thereby latched to the piston 3 again and the locking component 26 is held in its fully retracted position in the retaining collar 24, pre-loaded against the top of the piston 3 by the Bellville washers 34. The camming of the balls 38 out of the groove 64 also releases the detent and the spring 66 is therefore free to return the nested and latched piston and cylinder 3, 6 to their fully retracted position within the housing 1, as shown in FIG. 2.

Figure 12:
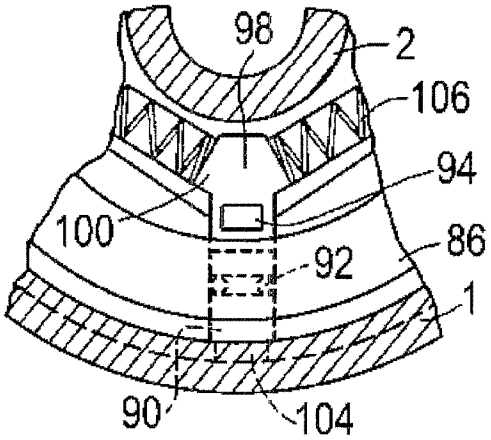
FIG. 12 is a scrap cross-sectional view on line XII-XII in FIG. 10.

FIGS. 10-12 diagrammatically illustrate a second embodiment of the invention. Like reference numbers denote like components to those in the preceding Figures. The proximal end of the piston 3 comprises a number of axially extending, radially distributed cam fingers 80. A series of radial latching elements 7 are received in corresponding bores in the piston proximal end. Roll pins 82 are received in longitudinal bores which glancingly intersect the latching element bores. The parts of the roll pins protruding into the latching element bores abut flats 84 machined in the latching elements to orient and hold them captive.

The cylinder 6 comprises a flange 86 at its proximal end, accommodating a series of radial bores 88 corresponding to the cam fingers 80. Each bore 88 receives a cylindrical portion of a plunger 90, slidingly sealed to the bore 88 by an O-ring 92. Each cam finger 86 is received in a rectangular sectioned, angled, tapered, aperture 94 in the associated plunger 90. A closure ring 96 (omitted in FIG. 12 so as to expose underlying parts) is screwed into a central aperture in the flange 86, so as to abut flats 98 on head portions 100 of the plungers 90. The closure ring 96 mounts the gas inlet sleeve sliding seal 13 in its central bore and is sealed to the flange central aperture by an annular static seal 102. The head portion 100 of each plunger 90 is braced against the head portions of neighbouring plungers by a pair of compression springs 106 (see FIG. 12). In this way, the plungers 90 are outwardly biased in the bores 88. The radially outer ends of the plungers 90 are extendable from the flange bores 88 in a manner described below, for reception in a complementary detent groove 104 provided around the inner circumference of the housing 1 near to its distal end. The closure ring 96 permits access for assembly of the piston 3, latching elements 7, plungers 90 and springs 106 within the cylinder 6.

In operation, compressed gas is supplied to the entry sleeve 2 and causes the piston 3 and the cylinder 6 (locked to the piston by the latching elements 7) to extend together, relative to the housing 1. At the end of its extension, the flange 86 on the cylinder abuts the buffer surface 11 at the distal end of the housing 1. At this point, the outer tips of the plungers 90 lie adjacent to the detent groove 104 and the latching elements have just slid clear of the distal end of the entry sleeve 2. The piston 3 is therefore free to extend relative to the cylinder 6. In doing so, radially outer, angled, cam surfaces 108 on the cam fingers 80 press against a corresponding surface within the apertures 94 to urge the plungers radially outwardly; also being assisted by the springs 106. The plunger tips therefore emerge from the flange bores 88 to engage in the detent groove 104 and detain the cylinder in the fully extended position relative to the housing 1. In this position a bleed port 110 in the entry sleeve 2 also aligns with the plungers 90 so as to supply gas pressure to further assist in urging them radially outwardly. With the detent activated and the latching elements 7 disengaged, the piston 3 may continue to extend from the cylinder 6. This firstly fully withdraws the cam fingers 80 from the apertures 94 and finally causes a shoulder 112 at the proximal end of the piston to abut the buffer surface 15 at the distal end of the cylinder 6. The actuator is now fully extended.

The piston 3 may be provided with a pressure venting valve (not shown) similar to that of the previously described embodiment, which is opened by release of an ejected load. The actuator may similarly be provided with an internal return spring (not shown). In fact either embodiment of the actuator may be biased to the contracted state by any suitable means, e.g. metal tension springs or stretched elastomeric elements such as bungee cords or the like, provided either internally or externally of the actuator or both. In the FIG. 10 embodiment, the piston and cylinder are maintained at a fixed rotational orientation to each other throughout the extension and retraction cycle, e.g. by matched out-of-roundness, or by means of a suitable key and keyway combination 116 or the like. This ensures that when the piston 3 nears its fully retracted state in the cylinder 6, the cam fingers 80 will re-enter the plunger apertures 94. A radially inner cam surface 114 on each finger 80 then retracts each plunger from the groove 104, releasing the detent. The latching elements 7 are pressed radially outwardly by engagement with the gas entry sleeve 2, so as to re-engage and latch the cylinder 6 to the piston 3. The piston and cylinder may then be urged in unison back into the housing 1 by the return biasing means.

In an alternative embodiment shown in FIGS. 13-15, the cam fingers 80 are replaced by a continuous annular flange 117 carrying the outer and inner cam surfaces 108, 114. The aperture 94 in plunger 90 is accordingly replaced by a slot 120 defined between a pair of jaws 118 extending forwardly from the head of the plunger, towards the distal end of the actuator. The plunger head is provided on either side with a projecting pin 122 for locating an end of the corresponding spring 106. In this embodiment, there is no need to maintain a fixed rotational orientation between the piston 3 and cylinder 6.

Note that in the embodiments of FIGS. 10-15, the latching elements 7 are in fact redundant in some circumstances. They merely provide an additional safety/stress relief feature for the cam fingers 80/cam flange 117 and plungers 90. During the first stage of piston 3/cylinder 6 simultaneous extension, the plungers 90 are prevented from moving radially outwardly by contact with the interior wall of the housing 1. They thus engage the outer cam surfaces 108 of the fingers 80/flange 117 and prevent the piston 3 from extending relative to the cylinder 6 until the plungers 90 are free to move into the groove 104 and can release the fingers 80/flange 117. The cam fingers 80/flange 117 and plungers 90 therefore also serve to latch the piston and cylinder together during the first stage of the actuator extension; as well as forming the detent for locking the extended cylinder to the housing for extension of the piston in the second stage of the actuator extension. The latching elements 7 therefore share with the fingers 80/flange 117 the stress of accelerating the cylinder 6 during the first stage of the actuator extension. They also reduce the wedging force of the plungers 90 against the inner wall of the housing 1; albeit at the expense of generating a similar wedging action between their radially inner ends and the outer surface of the inlet sleeve 2. The latching elements 7 may therefore be omitted where the cylinder acceleration is sufficiently low and/or the cylinder mass is sufficiently low and/or the cam fingers are sufficiently robust and/or the angle of the cam face 108 is sufficiently steep.

The invention claimed is:

1. A telescopic actuator comprising an inner component, an intermediate component and an outer component, all telescopingly interfitted together, the inner component comprising a fluid outlet at one end, the intermediate component making a sliding seal with the inner component and comprising an end surrounding the fluid outlet end, the outer component making a first sliding seal with the intermediate component and a second sliding seal with the inner component, and a detent operative to hold the outer component in an extended position relative to the inner component; characterized in that the detent is releasable by retraction of the intermediate component into the outer component, to allow relative sliding movement between the inner and outer components so that the telescopic actuator is retractable.

2. A telescopic actuator as defined in claim 1, further comprising a valve operable to release internal fluid pressure when the assembly reaches an extended position.

3. A telescopic actuator as defined in claim 2, in which the pressure release valve is openable by separation of a load from the intermediate component.

4. A telescopic actuator as defined in claim 1, comprising means for biasing it towards a retracted position.

5. A telescopic actuator as defined in claim 4, in which the biasing means comprises (a) means for connecting the interior of the telescopic actuator to a source of pressure lower than ambient pressure so that ambient pressure acts to cause retraction of the telescopic actuator, or (b) a linear actuator provided to return the telescopic actuator to the retracted state, or (c) resilient means to bias the telescopic actuator towards the retracted state.

6. A telescopic actuator as defined in claim 4, in which the biasing means comprises a tension spring.

7. A telescopic actuator as defined in claim 1, in which the detent is mounted to a proximal end of the outer component, where it may be released by engagement with a proximal end of the intermediate component, as the intermediate component moves towards a retracted position relative to the outer component.

8. A telescopic actuator as defined in claim 1, in which the intermediate component is latched to the outer component so that the outer component is transported with the intermediate component during an initial stage of piston extension.

9. A telescopic actuator as defined in claim 8, in which a radially movable latching element is engageable in a recess made in a bore of the outer component, and is prevented from disengaging from this recess until the end of the initial extension stage, by a surface of the inner component.

10. A telescopic actuator as defined in claim 1, in which the telescopic actuator comprises an outer support structure or housing that guides the outer component for sliding movement along the inner component.

11. A telescopic actuator as defined in claim 10, in which an interior space within the outer support structure or housing comprises a pressure bleed port in communication with a pressurized fluid supply.

12. A telescopic actuator as defined in claim 10, in which the detent comprises a component that is radially outwardly biased for reception in an internal recess in the support structure when the outer component is in an extended position.

13. A telescopic actuator as defined in claim 12, in which the radially outwardly biased component comprises a locking ball.

14. A telescopic actuator as defined in claim 12, in which the radially outwardly biased component is held in a recess in an outer surface of the intermediate component by a surface of the support structure or housing thereby to comprise the latching element.

15. A telescopic actuator as defined in claim 12, in which the detent further comprises a locking component that is biased axially of the outer component so as to move behind the radially outwardly biased component and lock it in the extended position.

16. A telescopic actuator as defined in claim 15, in which the locking component cams the radially outwardly biased component radially outwardly as the outer component reaches its fully extended position.

17. A telescopic actuator as defined in claim 16, in which the locking component contacts and moves together with the intermediate component as the outer component is transported with the intermediate component during an initial stage of piston extension.

18. A telescopic actuator as defined in claim 17, in which the locking component continues to contact the intermediate component as the locking component moves behind the radially outwardly biased component and the intermediate component begins to extend with respect to the outer component.

19. A telescopic actuator as defined in claim 15, in which, when the intermediate component moves towards the retracted position, its proximal end strikes the locking component and knocks it out of position from behind the radially outwardly biased component.

20. A telescopic actuator as defined in claim 15, in which, when the intermediate component moves towards the retracted position, the outer component acts to cam the radially outwardly biased component out of the recess in the support structure and into the recess in the intermediate component.

21. A telescopic actuator as defined in claim 15, in which the inner component comprises a pressure bleed port communicating with a space between the proximal end of the outer component and the locking component, as the locking component moves behind the radially outwardly biased component.

22. A telescopic actuator as defined in claim 12, in which the radially outwardly biased component is engaged and moved radially inwardly by a cam surface at the proximal end of the intermediate component as the intermediate component moves towards its fully retracted position relative to the outer component.

23. A telescopic actuator as defined in claim 22, in which the intermediate component is separately latched to the outer component so that the outer component is transported with the intermediate component during an initial stage of piston extension.

24. A telescopic actuator as defined in claim 23, in which a separate radial latching element is engageable in a recess in a bore of the outer component, and is prevented from disengaging from this recess until the end of the initial extension stage, by a surface of the inner component.

* * * * *